United States Patent [19]

Zima et al.

[11] 4,154,713

[45] May 15, 1979

[54] POLYMER DISPERSIONS AS A CASEIN REPLACEMENT

[76] Inventors: Herbert Zima, Eichenweg 7, 8042 Graz; Josef Forstner, Berliner Ring 47, 8010 Graz, both of Austria

[21] Appl. No.: 533,812

[22] Filed: Dec. 18, 1974

[30] Foreign Application Priority Data

Dec. 21, 1973 [AT] Austria ..... 10762/73

[51] Int. Cl.[2] ..... C08L 33/00

[52] U.S. Cl. ..... 260/29.6 TA; 260/29.6 HN; 428/514

[58] Field of Search ..... 260/29.6 TA, 29.6 HN

[56] References Cited

U.S. PATENT DOCUMENTS

| | | | |
|---|---|---|---|
| 3,323,980 | 6/1967 | Poschmann et al. | 260/29.6 HN |
| 3,404,114 | 10/1968 | Snyder et al. | 260/29.6 TA |
| 3,634,298 | 1/1972 | Wamsley et al. | 260/29.6 TA |
| 3,677,989 | 7/1972 | Jenkinson | 260/29.6 TA |
| 3,746,671 | 7/1973 | Zima et al. | 260/29.6 TA |
| 3,853,803 | 12/1974 | Anderson et al. | 260/29.6 TA |

FOREIGN PATENT DOCUMENTS 2123857 5/1971 Fed. Rep. of Germany.

*Primary Examiner*—Maurice J. Welsh
*Attorney, Agent, or Firm*—A. W. Breiner

[57] ABSTRACT

Polymer dispersions useful as a replacement for casein in paper coatings, and paper coating compositions containing such dispersions, are described. The dispersions comprise from about 85 to 95 percent by weight of an ethylenically unsaturated monomer free from additional functionality, i.e., styrene or vinyl esters of acetic acid and/or propionic acid, and from about 5 to 15 percent by weight of acid, i.e., acrylic acid, and basic, i.e., 1-vinylimidazole, monomers. Paper coating compositions containing the dispersion as a casein substitute when applied to paper in a conventional manner have excellent properties including whiteness, wet rub resistance, and water resistance.

6 Claims, No Drawings

POLYMER DISPERSIONS AS A CASEIN REPLACEMENT

FIELD OF INVENTION AND BACKGROUND

The present invention is directed to novel polymer dispersions and, more particularly, to polymer dispersions useful as replacements for casein in paper coatings, and to paper coating compositions containing the polymer dispersions.

Paper coating compositions for the preparation of coating printing papers normally consist of a slurry of pigments and fillers in an aqueous dispersion of a binder. The most commonly used binders are blends of natural binders, such as casein or starch, with synthetic binders which are usually polymer dispersions. Continuing attempts have been made and are going forward to replace casein in paper coatings, particularly for offset paper, with resin dispersions due to the high price; the irregularities and sensitivity to bacteria of casein. The primary requirement imposed on a resin dispersion to be used as a substitute for casein is a pigment binding capacity and wet rub resistance of the coated paper equal to that of, or obtained with casein without having the stability on shear stress and the desired low viscosity of the coating adversely influenced.

In the art, aqueous resin dispersions are described as the sole binder in paper coatings, i.e., no natural binders are used. For example, Deutsche Offenlegungsschrift No.2,123,857 describes mixed polymer dispersions thickened with alkali which are based on (meth)acrylates and other ethylenically unsaturated monomers, e.g., styrene, alkylene mono- or dicarboxylic acids and from 0 to 20 percent of monomers carrying one ethylenic bond, at least one polar group or additional ethylenic bonds. These dispersions are purported to convey enhanced water retention to the paper coatings either along or in admixture with other binder dispersions. However, these dispersions do not meet the criterion with respect to web rub resistance and, owing to the substantial thickening in the alkaline range, they cannot be used in satin white paper coatings. According to Deutsche Auslegeschrift No. 1,190,321, wet rub resistant papers are obtained using coatings containing an aqueous dispersion of acrylates, acrylic acid, and acrylamide, which are slightly alkaline due to the presence of volatile amines such as ammonia, ethylamine, and trimethylamine. These dispersions are incompatible in satin white paper coatings and, furthermore, they have a strong odor owing to the volatility of the amine. Austrian Pat. No. 253,349 describes a blend of dispersions A and B, dispersion A containing 90–10 percent by weight of vinyl acetate and/or vinyl propionate, 10–90 percent by weight of esters of acrylic acid and/or methacrylic acid with alcohols having from 4 to 8 carbon atoms, and 0–10 percent by weight of other copolymerizable ethylenically unsaturated compounds; and dispersion B containing 15–55 percent by weight of acrylic acid and/or methacrylic acid, 25–45 percent by weight of esters of acrylic acid and/or methacrylic acid with alcohols containing 1 to 4 carbon atoms, and 20–40 percent by weight of ethylenically unsaturated monomers which form water-insoluble homopolymers. Such a blend was found to be unusable in pigment combinations containing satin white. Furthermore, the claimed dispersions coated on paper do not have sufficient water resistance for coating on paper to be used for offset printing. A further disadvantage of the dispersions claimed in Austrian Pat. No. 253,349 is that they cannot be combined with other resin binders.

THE INVENTION AND GENERAL DESCRIPTION

It has now been found that polymer dispersions comprising a combination of ethylenically unsaturated monomers and monomers having acid and basic character are an excellent substitute for casein in a paper coating composition. The invention is concerned, therefore, with polymer dispersions as a casein substitute in paper coatings and are characterized in that they contain

- from about 85–95 percent by weight of ethylenically unsaturated monomer(s) without additional functionality, and preferably styrene or vinyl esters of acetic acid and/or propionic acid and/or esters of acrylic acid with monoalcohols having from about 1 to 8 carbon atoms; and
- from about 5–15 percent by weight of preferably equimolecular proportions of acid and basic monomers.

Surprisingly the paper coatings containing such dispersions as a replacement for casein afford the high web rub resistance required for practical application, which heretofore could be obtained only through the use of casein. Furthermore, the dispersions can be combined with other suitable dispersions in the formulation of satin white paper coatings.

The acid monomers for use in the production of the dispersions of the invention include acrylic acid, methacrylic acid, maleic acid, fumaric acid, itaconic acid, aconitic acid, vinyl sulfonic acid and mixtures thereof; whereas the basic monomers include 1-vinylimidazole, tertiary butylaminoethylmethacrylate, vinylpyridine, vinylcarbazole and mixtures thereof. Preferably 1 mole of basic monomer and 1 mole of acid monomer is used at a level of from about 5–15 percent of the total monomers. However, the ratio of acid to basic monomer can vary from about 0.2 to 1.0 and from 1.0 to 0.2 on a molar basis.

The ethylenically unsaturated monomer, without reactive functionality other than the double bond, for use in producing the dispersions include styrene vinyl acetate, acrylates of monoalcohols having from about 1 to 8 carbon atoms, (meth)acrylamide or diesters of alpha, beta-unsaturated dicarboxylic acids, etc. Preferably, as noted above, the preferred monomers are styrene or vinyl esters of acetic acid and/or propionic acid or esters of acrylic acid with monoalcohols having from about 1 to 8 carbon atoms and mixtures thereof.

Preferred monomer combinations for the preparation of the dispersions of the invention are:

45–50 percent by weight styrene
36–41 percent by weight butylacrylate
4–5 percent by weight methacrylamide
3–4 percent by weight acrylic acid
0.5–2.5 percent by weight sodium vinyl sulfonate
4.5–5.5 percent by weight 1-vinylimidazole; or 50–54 percent by weight styrene
33–37 percent by weight ethylhexylacrylate
4–5 percent by weight methacrylamide
3–5 percent by weight acrylic acid
4.5–5.5 percent by weight 1-vinylimidazole; or 70 percent by weight vinylacetate
15 percent by weight dibutylfumarate 5 percent by weight butyl acrylate
5 percent by weight acrylic acid
5 percent by weight N-tert.-butyl-aminoethylmethacrylate For the styrol/acrylate dispersions, emulsifiers such as p-dodecyldiphenylether sodium disulfonate, dodecylbenzosulfonate or polyethoxylated and then sulfated alkylphenol, together with polyethoxylated alkylphenols, are preferred. Emulsifiers particularly suitable for vinyl acetate copolymer dispersions are sulfo-succinates and with particular effect, the disodium salt of N-octadecyl sulfo-succinic acid amide together with polyethoxylated alkyl phenols. Other known emulsifiers can be employed. The dispersions are produced in the usual and known manner.

EXAMPLES

The following examples are illustrative of the invention but are not intended to limit the scope thereof. Parts are by weight unless otherwise stated.

Example 1

The following emulsion I is charged to a polymerization reactor:

300.00 parts deionized water
1.85 parts p-dodecyl-diphenylether-sodium disulfonate
1.35 parts ethoxylated octylphenol (with 16 moles ethylene oxide)
4.00 parts methacrylamide
22.00 parts styrene
18.00 parts butylacrylate
5.70 parts acrylic acid
0.40 parts ammoniumpersulfate The emulsion is heated to 77° C. and over a period of 2 hours. Emulsion II, as follows, is added:

500.00 parts deionized water
7.15 parts p-dodecyl-diphenylether-sodium disulfonate
5.36 parts ethoxylated octylphenol (with 16 moles ethylene oxide)
28.00 parts methacrylamide
330.00 parts styrene
270.00 parts butylacrylate
20.00 parts acrylic acid
11.25 parts sodium vinylsulfonate
2.00 parts ammoniumpersulfate Simultaneously with the addition of emulsion II, a solution of 37.5 parts 1-vinylimidazole in 100 parts water is separately added within the same time period. During the additions, the temperature is slowly raised to 88° C. At the end of the addition, 1 part ammoniumpersulfate in 15 parts water is added and the temperature is raised to 95° C. The temperature is held at 95° C. for 1 hour and the batch is cooled. The obtained stable dispersion has a solids content of 44 percent.

Example 2

Following the procedure of Example 1, emulsion 2-I, as follows:

300.00 parts deionized water
0.13 parts octylphenol reacted with 2 moles ethylene oxide and sulfated
0.90 parts ethoxylated octylphenol (with 16 moles ethylene oxide)
4.00 parts methacrylamide
25.60 parts styrene
16.10 parts ethylhexylacrylate
5.60 parts acrylic acid
0.40 parts ammoniumpersulfate and emulsion 2-II, as follows:

490.00 parts deionized water
7.75 parts octylphenol reacted with 2 moles ethylene oxide and sulfated
5.80 parts ethoxylated octylphenol (with 16 moles ethylene oxide)
28.00 parts methacrylamide
358.00 parts styrene
241.00 parts ethylhexylacrylate
23.00 parts acrylic acid and
2.00 parts ammoniumpersulfate are polymerized. The procedure includes the addition of the 1-vinylimidazole.

Example 3

In a polymerization reactor, 5.85 parts disodium salt of N-octadecyl sulfo-succinic acid amide
5.81 parts ethoxylated octylphenol (with 16 moles ethylene oxide) and
4.30 parts acrylic acid, in
200.00 parts deionized water are dissolved, neutralized to pH 6.5 with 20 percent NaOH, while cooling and 30.00 parts vinylacetate
6.00 parts dibutylfumarate
4.10 parts butylacrylate
4.25 parts dodecylmercaptan and
2.00 parts ammoniumpersulfate are added while stirring to produce emulsion 3-I. In an emulsifying vessel 11.70 parts disodium salt of N-octadecyl-sulfo-succinic acid amide
11.75 parts ethoxylated octylphenol (with 16 moles ethylene oxide) and
17.20 parts acrylic acid in
315.00 parts deionized water are dissolved and neutralized to pH 6.5 with 20 percent NaOH while cooling and 270.00 parts vinylacetate
54.00 parts dibutylfumarate
17.40 parts butylacrylate and
2.00 parts ammoniumpersulfate are added while stirring to produce emulsion 3-II. Polymerization is accomplished by heating emulsion 3-I to 70° C. and emulsion 3-II is then added to emulsion 3-I over a period of 3 hours. During the same time, 21.5 parts of butyl-aminoethyl methacrylate are separately added. After the addition, the batch is allowed to react for 6 additional hours while the temperature is slowly raised to 94° C. The batch is cooled to yield a stable dispersion having a solids content of 44 percent.

Evaluation of the dispersions of the invention in paper coatings

The dispersions of the invention are tested in paper coatings in comparison with casein. For this purpose, components as follows 70.0 percent by weight caolin (English China clay SPS)
30.0 percent by weight calciumcarbonate (Millicarb)
0.5 percent by weight polyacrylic acid sodium
0.1 percent by weight sodiumhydroxide (solid)
12.5 percent by weight polymer dispersion 4.0 percent by weight casein or a dispersion of the invention are uniformly dispersed. The pH-value of the composition is adjusted to 9 with 5 percent sodium hydroxide solution. The solids content is about 50 percent.

The polymer dispersions used in the formulation are

1. Dispersions of styrene butylacrylate prepared in a conventional manner, e.g., according to Austrian Pat. No. 295,315.
2. Dispersions of vinylacetate prepared in a conventional manner, e.g., as described in Austrian Pat. No. 304,071.

Composition of the paper coatings.

| Paper coating | Percent dispersion according to Example 1 | 2 | 3 | Percent casein | Percent polymer dispersion Styrene/Butylacrylate | Vinylacetate |
|---|---|---|---|---|---|---|
| 1 | — | — | — | 4 | 12.5 | — |
| 2 | 4 | — | — | — | 12.5 | — |
| 3 | — | 4 | — | — | 12.5 | — |
| 4 | — | — | 4 | — | 12.5 | — |
| 5 | — | — | — | 4 | — | 12.5 |
| 6 | 4 | — | — | — | — | 12.5 |
| 7 | — | 4 | — | — | — | 12.5 |
| 8 | — | — | 4 | — | — | 12.5 |

Raw paper was coated with the paper coating compositions at a rate of 9 g/m$^2$. The coated paper was calendered with a super calender to a satin finish and stored for 24 hours at 23° C. and 55 percent of relative humidity.

The paper coatings and coated papers were subjected to the following tests, the results of which are tabulated in Table I:

1. Viscosity: measured
   (a) with Ford cup No. 4 in seconds
   (b) with Brookfield viscosimeter RVT 100, spindle 5, 100 rpm.
2. Water retention:
   measured with water retentiometer of Venema Automation N.V., Smirnoffstraat 3-5, Groningen, Holland.
3. Pick test:
   (a) measured with IGT-Probedruckgerät A 1 with weight of Transgrafik Rijkstraatweg 825, Wasenaar 4, Holland.
   The values are a relative measure for the pigment binding capacity.
   (b) Dennison test:
   In this test, the resistance of a coated paper surface is measured to drawing according to TAPPI-test T 459m-48.
4. K+N repel:
   This test measures the resistance of a surface to the penetration of printing ink. In this test a standardized printing ink on oil is applied to the tested paper, allowed to contact it for 2 minutes and is then completely removed from the surface. The TAPPI lightness is measured on the printing ink treated paper and compared to the color of untreated paper. The K+N repulsion is calculated to the equation $$K + N \text{ repulsion } (\%) = 100 - 100 \frac{\text{initial color} - \text{color of treated paper}}{\text{initial color}}$$

5. Whiteness:
   Zeiss Elrepho according to DIN 5033.
6. Wet rub resistance:
   made with blade test apparatus of Venema Automation N. V., Smirnoffstraat 3-5, Groningen, Holland (modified Adams tester).
7. Coating water resistance:
   The surface of the coated paper is wetted with water and, after 10 seconds, rubbed with a finger tip until the pigment comes through.
   — indicates not acceptable.
   + indicates acceptable.

Table I

| Paper coating | Solids % | Viscosity Brook. cp. | Ford s | Water retention s | Pick test IGT cm/s | Pick test Dennison | K + N repulsion % | Whiteness % | Wet rub resistance | Coating water resistance |
|---|---|---|---|---|---|---|---|---|---|---|
| 1 | 47.7 | 100 | 15.7 | 23.5 | 43 | 6 | 39.5 | 85.8 | 8.5 | — |
| 2 | 47.5 | 112 | 15.6 | 20.6 | 43 | 6 | 34.8 | 86.1 | 13 | + |
| 3 | 47.4 | 96 | 14.8 | 21.6 | 45 | 6 | 44.5 | 86.1 | 11 | + |
| 4 | 47.7 | 96 | 15.3 | 21.3 | 42 | 6 | 45.2 | 85.7 | 13 | + |
| 5 | 48.6 | 104 | 17.2 | 22.1 | 42 | 6 | 43.2 | 85.5 | 8 | — |
| 6 | 48.6 | 188 | 24.0 | 20.6 | 42 | 6 | 44.5 | 85.5 | 15 | + |
| 7 | 49.0 | 192 | 21.8 | 19.3 | 44 | 5 | 40.0 | 86.0 | 21 | + |
| 8 | 49.0 | 100 | 22.1 | 22.1 | 43 | 6 | 41.7 | 85.6 | 19 | + |

As apparent from the results of Table I, the polymer dispersions of Examples 1, 2, and 3 made in accordance with the present invention when used in paper coating compositions have properties equivalent to or better than the properties obtained with casein. However, if the dispersions are prepared according to Examples 1, 2, and 3 without inclusion of the basic monomers, the paper coatings prepared therefrom have no water resistance and very poor wet rub resistance.

The dispersions prepared according to Examples 1-3 were also evaluated in satin white paper coatings, the compositions being as follows:

50.0 parts caolin (English China Clay SPS)
20.0 parts $CaCO_3$ (Millicarb)
30.0 parts satin white
2.0 parts polyacrylic acid sodium
0.2 parts NaOH
11.0 parts casein or the dispersion of the invention
11.0 parts polymer dispersion The above compositions were dispersed in known manner, and thereafter the paper coating compositions were adjusted to a pH value of 12 with a 5 percent sodium hydroxide solution, providing a solids content of about 42-43 percent.

Composition of the paper coatings.

| Paper coating | Percent dispersion according to Example 1 | 2 | 3 | Percent Casein | Percent polymer dispersion Styrene/Butylacrylate | Vinylacetate |
|---|---|---|---|---|---|---|
| 1 | — | — | — | 11 | 11 | — |

-continued

Composition of the paper coatings.

| Paper coating | Percent dispersion according to Example 1 | 2 | 3 | Percent Casein | Percent polymer dispersion Styrene/Butyl-acrylate | Vinylacetate |
|---|---|---|---|---|---|---|
| 2 | 11 | — | — | — | 11 | — |
| 3 | — | 11 | — | — | 11 | — |
| 4 | — | — | 11 | — | 11 | — |
| 5 | — | — | — | 11 | — | 11 |
| 6 | 11 | — | — | — | — | 11 |
| 7 | — | 11 | — | — | — | 11 |
| 8 | — | — | 11 | — | — | 11 |

Table II

| Paper coating | Solids % | Viscosity Brook. cp | Ford s | Water retention s | Pick test IGT cm/s | Pick test Dennison | K + N repulsion % | Whiteness % | Wet rub resistance | Coating water resistance |
|---|---|---|---|---|---|---|---|---|---|---|
| 1 | 41.7 | 108 | 29.0 | 25.0 | 43 | 8 | 37.9 | 85.5 | 13 | — |
| 2 | 41.2 | 184 | 24.1 | 25.9 | 43 | 7 | 36.2 | 86.1 | 8 | + |
| 3 | 41.3 | 184 | 28.6 | 21.0 | 42 | 6 | 32.8 | 86.1 | 15 | + |
| 4 | 41.2 | 128 | 25.4 | 19.9 | 42 | 6 | 39.0 | 85.5 | 15 | + |
| 5 | 43.6 | 152 | 33.3 | 23.8 | 45 | 8 | 43.3 | 85.3 | 11 | — |
| 6 | 42.7 | 260 | 42.1 | 18.6 | 43 | 8 | 39.6 | 85.7 | 20 | + |
| 7 | 42.7 | 660 | 48.2 | 16.3 | 42 | 8 | 40.4 | 85.4 | 52 | + |
| 8 | 43.0 | 280 | 46.0 | 17.6 | 42 | 8 | 47.0 | 85.7 | 42 | + |

The tests were made as described hereinbefore.

As seen from the results of Table II, the polymer dispersions of the present invention provide coating compositions which, when used in satin white paper coatings, are equivalent to or superior to coating compositions which utilize casein. Accordingly, the compositions can be used as total replacements for natural resins such as casein which are relatively expensive. In the aforesaid examples, the ethylenically unsaturated monomers can be replaced by other unsaturated monomers provided the monomer is free of functionality other than the double bond. Additionally, the percentage of the monomers can be varied within the designated range of from about 85 to 95 percent by weight. Different acid and basic monomers can be selected, and these monomers used at different percentages by weight of total monomer falling within the range of from about 5 to 15 percent; and, additionally, the ratio of acid and basic monomer to each other can be suitably varied. Preferably, however, the basic and acid monomers will be used in equal molecular proportions. The paper coating compositions containing the polymer dispersions of this invention can be selected from any of the compositions or combinations thereof commonly employed in the art, it only being necessary to have compatibility. These compositions usually contain as essential components, pigments, fillers, and aqueous binders, the percentages of each being adjusted to provide the necessary properties, including viscosity.

One skilled in the art will appreciate that various other modifications can be made within the framework and scope of the present invention. These modifications being within the ability of one skilled in the art are embraced by the appended claims.

It is claimed:

1. An aqueous polymer dispersion comprising the interpolymerization product of the monomer combination as follows:

45–50 percent by weight styrene
36–41 percent by weight butyl acrylate
4–5 percent by weight methacrylamide
3–4 percent by weight acrylic acid
0.5–2.5 percent by weight sodium salt of vinylsulfonic acid
4.5–5.5 percent by weight 1-vinylimidazole, said percent by weight being of said polymer.

2. An aqueous polymer dispersion comprising the interpolymerization product of the monomer combination as follows:

50–54 percent by weight styrene
33–37 percent by weight ethylhexylacrylate
4–5 percent by weight methacrylamide
3–5 percent by weight acrylic acid
4.5–5.5 percent by weight 1-vinylimidazole, said percent by weight being of said polymer.

3. An aqueous polymer dispersion comprising the interpolymerization product of the monomer combination as follows:

70 percent by weight vinylacetate
15 percent by weight dibutylfumarate
5 percent by weight butyl acrylate
5 percent by weight acrylic acid
5 percent by weight N-tert.-butyl-aminoethylmethacrylate, said percent by weight being of said polymer.

4. In a paper coating composition comprising a pigment, a filler, and an aqueous dispersion of a binder, the improvement wherein the aqueous dispersion of binder includes an aqueous polymer dispersion comprising the interpolymerization product of from about 45–50 percent by weight styrene
36–41 percent by weight butyl acrylate
4–5 percent by weight methacrylamide
3–4 percent by weight acrylic acid
0.5–2.5 percent by weight sodium salt of vinylsulfonic acid
4.5–5.5 percent by weight 1-vinylimidazole.

5. In a paper coating composition comprising a pigment, a filler, and an aqueous dispersion of a binder, the improvement wherein the aqueous dispersion of binder includes an aqueous polymer dispersion comprising the interpolymerization product of from about 50–54 percent by weight styrene
33–37 percent by weight ethylhexylacrylate
4–5 percent by weight methacrylamide
3–5 percent by weight acrylic acid
4.5–5.5 percent by weight 1-vinylimidazole.

6. In a paper coating composition comprising a pigment, a filler, and an aqueous dispersion of a binder, the improvement wherein the aqueous dispersion of binder includes an aqueous polymer dispersion comprising the interpolymerization product of from about 70 percent by weight vinylacetate
15 percent by weight dibutylfumarate
5 percent by weight butyl acrylate
5 percent by weight acrylic acid
5 percent by weight N-tert.-butyl-aminoethylmethacrylate.

* * * * *